United States Patent [19]

Benoit

[11] Patent Number: 4,597,494

[45] Date of Patent: Jul. 1, 1986

[54] HORSESHOE FOLDED AND CENTER UNWOUND PLASTIC BAGS

[75] Inventor: Gordon Benoit, Macedon, N.Y.

[73] Assignee: Mobil Oil Corporation, New York, N.Y.

[21] Appl. No.: 687,792

[22] Filed: Dec. 31, 1984

[51] Int. Cl.[4] ..... B65D 85/67

[52] U.S. Cl. ..... 206/390; 206/409; 206/494; 221/45; 221/63; 53/429; 53/430; 53/438; 242/55.2; 383/37

[58] Field of Search ..... 206/83.5, 389, 390, 206/409, 410, 494, 554; 221/45, 63; 53/429, 430, 438; 242/55.2; 383/37

[56] References Cited

U.S. PATENT DOCUMENTS

| | | | |
|---|---|---|---|
| 1,110,689 | 9/1914 | Hoberg | 206/494 |
| 2,555,205 | 5/1951 | Steffens | 206/391 |
| 3,249,255 | 5/1966 | Cohen | 221/63 |
| 3,395,830 | 8/1968 | Buttery | 221/63 |
| 3,515,333 | 6/1970 | Kotkas et al. | 206/410 |
| 3,606,080 | 9/1971 | Lynch et al. | 221/63 |
| 3,645,759 | 2/1972 | Heiligman | 53/429 |
| 3,718,253 | 2/1973 | Smith | 206/554 |
| 4,002,264 | 1/1977 | Marchesani | 206/409 |
| 4,044,919 | 8/1977 | Olson | 221/63 |
| 4,349,123 | 9/1982 | Yang | 206/390 |
| 4,453,649 | 6/1984 | Origuchi | 206/554 |

FOREIGN PATENT DOCUMENTS

| | | | |
|---|---|---|---|
| 30506 | 6/1981 | European Pat. Off. | 221/63 |
| 619613 | 10/1953 | Fed. Rep. of Germany | 206/494 |
| 895742 | 11/1953 | Fed. Rep. of Germany | 206/494 |
| 1209406 | 10/1970 | United Kingdom | 206/554 |
| 1269157 | 4/1972 | United Kingdom | 221/63 |
| 2079249 | 1/1982 | United Kingdom | 206/554 |

*Primary Examiner*—William Price
*Assistant Examiner*—Brenda J. Ehrhardt
*Attorney, Agent, or Firm*—Alexander J. McKillop; Michael G. Gilman; Charles J. Speciale

[57] ABSTRACT

A method for minimizing twist in large plastic bags to be center-dispensed from a wound coreless roll of sequentially attached plastic bags. The roll is flattened or collapsed and folded at least once into a U, C, S, M, W, or accordion shape. The method is particularly effective for minimizing twisting of center-dispensed bags when the bags are at least as long as the inner core circumference. The method is also useful for imparting selected dimensions to the horseshoe folded roll that enable the roll to be inserted into a dispensing carton having dimensions preferred by users of the bags, such as cartons having square ends.

23 Claims, 15 Drawing Figures

HORSESHOE FOLDED AND CENTER UNWOUND PLASTIC BAGS

BACKGROUND OF THE INVENTION

1. Field of the Invention

This invention relates to plastic bags and particularly relates to packaging and dispensing of plastic bags. It especially relates to singly dispensing and sequentially separating plastic bags from a plurality of attached bags within a package or carton.

2. Review of the Prior Art

Plastic bags of varying sizes are being used for an ever wider variety of purposes. When bags are to be removed and used by a customer in a self-serve situation, it is generally preferred that they be folded because rolls are not always easily manageable and may require a stand or other dispensing means. In some instances, however, such as produce bags in the produce section of a supermarket, the bags are dispensed from a roll mounted at approximately head height and are separated by tearing along a transverse line of perforations. Doing so, however, generally requires the use of both hands. Even when bags are to be used by a clerk within a supermarket, such as for protecting frozen foods, it is often desirable that they be dispensable from a shelf beneath a counter by using one hand. For such purposes, plastic bags are also often preferred in a folded arrangement.

However, folded plastic bags present their own problems. For example, an outstanding characteristic of plastic bags is their surface slipperiness which can cause an entire stack of folded bags to slide off a shelf when a single bag is pulled. This characteristic surface slipperiness has caused plastic bags to be provided with a means for dispensing from a package having some rigidity, such as a box made of stiff paperboard, as taught in U.S. Pat. No. 3,896,966.

U.S. Pat. No. 396,675 describes a flattened roll of toilet or wrapping paper having all of its lines of perforations or incisions along the same plane and having a stay passing through the lines of perforations to maintain them in a fixed position.

U.S. Pat. No. 714,652 also describes a flattened roll of toilet paper which is bent in a U-shape, as shown in FIG. 3, around a pasteboard core and having cuts along its inner or concave surface, whereby a neck or unsevered portion hangs down from its convex surface.

U.S. Pat. No. 733,283 relates to a flattened roll of toilet paper which is folded in a U or V-shape and supported by an extension passing through a slit in the paper, whereby the paper separates at this extension and hangs downwardly from the other side of the flattened roll.

U.S. Pat. No. 745,612 relates to a continuous strip of paper wound in roll form and partially severed to facilitate the removal of the detached sheets, with the roll being wound on a large core and flattened in the middle, the flattened roll being held by a detent at a point sufficiently distant from the point of severance to permit a partial withdrawal of the sheets from the front end of the roll before the strain of withdrawal is applied to the detent.

U.S. Pat. No. 1,170,590 describes a paper roll wound around a large core in the general form of a cylinder and provided with an inwardly extending longitudinal channel or groove, with a plurality of incisions cut in a single plane and opposite to the channel. The roll may also be flattened on either side of the channel.

U.S. Pat. No. 1,686,458 discloses folded but separated sheets of paper which are disposed in a paper holder in upwardly concave position for center dispensing.

U.S. Pat. No. 1,984,780 relates to a wax paper package formed by folding a lengthy sheet of wax paper lengthwise and into a flattened package which is then placed in a dispensing box while bent in a U-shape. Pulling on the outermost layer causes the U-shaped paper to tumble over and over until a desired length is obtained and the paper is severed along a cutting edge on the box.

U.S. Pat. No. 2,864,495 describes a center-dispensed roll of tissue paper which is disposed in a rectangular box having a hole at one end through which the paper is pulled.

U.S. Pat. No. 3,881,632 describes a compact dispensing package for facial tissues which comprises a top-dispensing carton, an inverted Y-shape support member within the carton, and a bundle of substantially uniform sheets, the bundle being folded upon itself into a U-shape and draped over the inverted Y-shape support member so that the middle of the carton is supported subjacent the top wall of the carton which is provided with a narrow dispensing aperture or opening for insertion of a thumb and forefinger and grasping the topmost sheet.

U.S. Pat. No. 3,896,966 discloses a bag dispensing package containing an assembly of slippery, separated, plastic bags folded at their mid-sections around a stiff panel which is substantially one-half of the height of the plastic bags, the folded end being exposed through a central opening whereby the outermost bag may be grasped and pulled through the opening.

U.S. Pat. No. 3,973,695 describes a dispensing container for premoistened, perforated towels which are provided as a roll in upright position within the container and beneath a dispensing outlet comprising a slot with a circular portion at one end and an enlarged portion at the other end, whereby the tissue can be pulled therethrough and tension can be selectively applied for separating the tissue along the perforations.

U.S. Pat. No. 4,002,264 also describes a flexible bag dispenser for a roll of interconnected moist tissues which are withdrawn from the center of the roll and passed through a restricted opening in one end of the bag dispenser.

U.S. Pat. No. 4,044,919 describes a thermoplastic bag dispensing assembly which comprises a dispensing carton and a number of separated plastic bags of the "fold and lock" type, having integral transversely extending ribs, whereby withdrawal of each bag through an elongated slot along the upper edge of the carton ensures that only the outermost bag in the stack of bags is grasped by a user and withdrawn.

U.S. Pat. No. 4,171,047 relates to a center-dispensed, longitudinally folded sheet of wickable material which is stood upright as a rolled web within an impervious container to provide moistened towelettes to users.

British Patent Application No. 2,106,862 describes a carton having a dispensing aperture disposed at one end and a roll of an elongated web which is perforated at regular intervals therewithin. The roll is dispensed from its center opening through the aperture in the carton, this aperture being provided with tapering constricted regions that enable a sufficient quantity of the web to be separated from the remaining portion thereof.

When a continuous web of material is dispensed endwardly from the center of a roll, whether or not the roll is flattened, as described in U.S. Pat. Nos. 2,864,495, 3,973,695, and 4,171,047 and British Pat. Application No. 2,106,862, the web is twisted once per withdrawn revolution. If a dispensed bag is half as long as the inside diameter of the roll, the bag has one-half of a complete twist; if equal in length to the inside diameter, the bag has one entire twist; and if twice as long as the inside diameter, it possesses two complete twists. With some materials, such as heavy-weight kraft paper, this twist may cause little difficulty because the material may possess enough memory to recover, thereby eliminating the twist. However, for a slippery-surfaced plastic having virtually no memory, the twist must be manually removed and can be decidedly inconvenient to the user. Such inconvenience is particularly pronounced when the user is pulling large trash or garbage bags from a dispensing container in which there is a center-unwindable roll of these bags, because the larger the bag, the more twist it is given during dispensing. Manually removing such twist is even more of a nuisance when dispensing industrial liners which have a film thickness of 0.6–0.8 mil.

There is accordingly a need for a method and means for dispensing large center-unwindable plastic bags with minimum hand manipulation by the user.

A carton for shipping and successively dispensing large plastic bags from a center-unwindable roll thereof should have as nearly square a configuration, in the dimensions that are perpendicular to the width of the bags, as possible in order to maximize the strength of the carton and its shipping, storing, and dispensing characteristics and convenience. There is consequently a need for a method that can selectively impart such a selected configuration to a roll of center-unwindable plastic bags being packaged into a carton.

SUMMARY OF THE INVENTION

It is an object of this invention to provide a method for storing large plastic bags in a dispensing box having selected dimensions.

It is another object to provide a method for convenient storage of such bags within a carton or box, wherein the bags are unwound from the center of a roll.

It is a further object to provide a method for convenient, endwise dispensing of successive individual bags and separating a selected bag from a center unwound roll with minimum untwisting required by the user.

In accordance with these objects and the principles of this invention, a method is herein provided which enables large plastic bags to be stored in a selected shape having dimensions of maximum convenience. This selective shape permits a dispensing box to be utilized which is of optimum strength and convenience for storage, transportation, and dispensing by the user. Furthermore, the storage method permits the stored bags to be center dispensed from a flattened or collapsed roll with minimum twist in each bag removed therefrom.

It has surprisingly been discovered that a roll of wound plastic bags can possess a selected final geometry, when flattened or collapsed, by choosing the correct inner roll diameter and roll thickness. It has further been determined that the larger the inner roll diameter for a given size bag, the less twist is encountered when removing a large bag from the roll by center unwinding. It has further been surprisingly discovered that if a collapsed roll is selectively folded, this minimizing of twisting is preserved. Such folding can be into a U shape, an S shape, an M shape, a W shape, or an accordion shape, for example. For convenience, all such folding shapes are hereinafter referred to as "horseshoe folded".

The invention may be described as a plastic bag dispensing assembly from which plastic bags may be sequentially dispensed with minimum untwisting thereof being needed, comprising:

A. a horseshoe-folded roll of attached plastic bags which are separated by transverse lines of perforations, this roll having an outer diameter and an inner diameter, the attached plastic bags extending from an innermost bag along the inner diameter to an outermost bag along the outer diameter, and the roll being flattened and horseshoe-folded along at least one fold line in parallel to the lines of perforations; and B. a dispensing carton within which the horseshoe-folded roll is stored, this carton having a dispensing opening through which the innermost bag is initially pulled by a user for dispensing thereof.

This dispensing opening preferably has at least one off-set slot means for grippingly engaging each of the attached plastic bags when selectively and successively slid thereinto, whereby the bag being pulled by the user is subject to sufficient tension to be torn from the succeeding bag along one line of perforations.

The method of the invention minimizes the degree of twist in a plastic bag which is to be tensionally dispensed from the central opening of a wound roll of attached plastic bags, the roll having an inner core diameter and an outer diameter, and the plastic bag having a dimension, measured in parallel to the inner circumference of the wound roll, that is at least as long as the inner circumference. The method comprises the following steps:

A. collapsing the wound roll;

B. horseshoe folding the collapsed roll into an approximately square shape, measured perpendicularly to the weakening lines that separate the bags; and C. inserting the horseshoe-folded roll into a carton having a dispensing opening in a side thereof.

In order to obtain a horseshoe-folded coreless roll which has a square configuration when viewed from an end thereof, in parallel to the lines of perforations, it has been discovered that, for industrial liners of 0.6–0.8 mil gauge and 250 count, a singly-folded roll having an inner diameter of 5 inches, a doubly folded roll having an inner diameter of 10 inches, and a triply folded roll having an inner diameter of 12 inches are the optimum choices. It has also been discovered that in order to produce no more than about 1.5 twists in an industrial liner, which is 46 inches long and of 0.6–0.8 mil gauge and is being pulled or dispensed from the center of a horseshoe-folded coreless roll, it is necessary to use an inner core or roll diameter of at least 10 inches. Such a nearly square roll configuration permits an equally square box or carton, having maximum shipping and storing strength and optimum convenience to the user, to be utilized for shipping, storing, and sequentially dispensing the bags.

DESCRIPTION OF THE PREFERRED EMBODIMENTS

Figure 1:
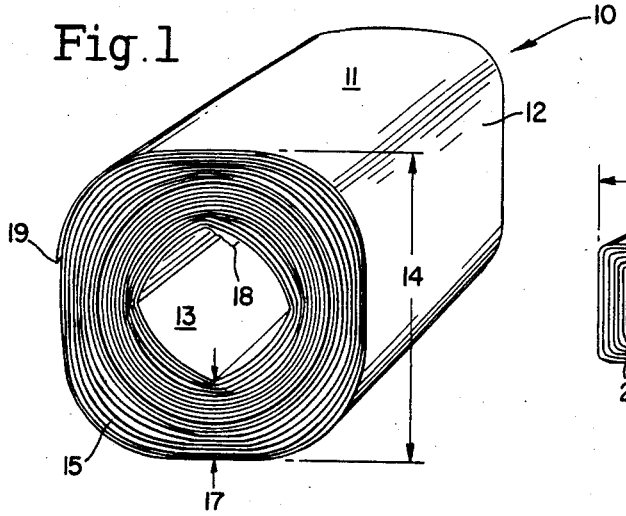
FIG. 1 is a perspective view of a coreless roll, as wound, of large plastic bags having a relatively large inner diameter.
Figure 2:
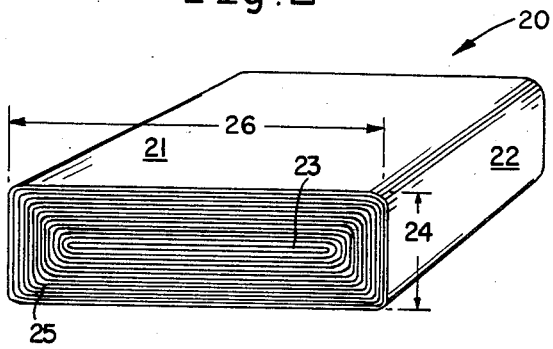
FIG. 2 is a perspective view of the same roll after collapsing it into a rectangular but highly flattened shape, as if confined in a box.

A coreless roll 10 of plastic bags which have previously been wound on a fairly large core is shown in FIG. 1. The roll has been slightly squared so that it has a top side 11, a vertical side 12, a thickness 17, and an inner core surface 13. The wound layers 15 of plastic bags begin with innermost bag 18 and end with outermost bag 19. The roll has a height 14 and is readily flattened, as seen in FIG. 2, to form a rectangular package 20 having a top surface 21 and a vertical surface 22 around an elongated center 23. Its thickness 24-to-width 26 ratio in this collapsed condition may or may not be highly suitable for packaging and dispensing.

Figure 3:
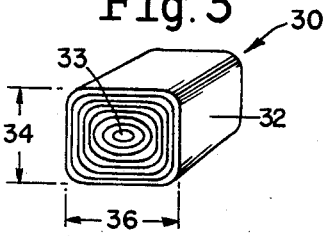
FIG. 3 is a perspective view of a tightly wound but coreless roll of plastic bags, having a small inner diameter, which can be molded into a square shape, as if confined in a box, when viewed endwise.
Figure 4:
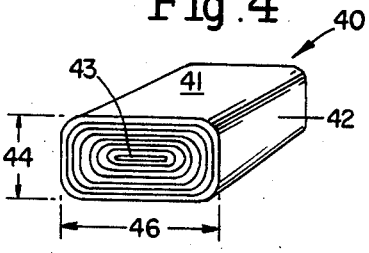
FIG. 4 is a perspective view of a similar roll with a larger inner diameter which has been molded into a rectangular shape, as if confined in a box, when viewed endwise.
Figure 5:
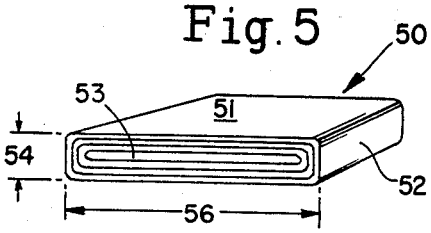
FIG. 5 is a perspective view, similar to FIGS. 3 and 4, in which a coreless roll having a very large inner diameter but little thickness has been flattened into a rectangular shape, as if confined in a box which has a large width-to-height ratio.

Indeed, the final geometry of a coreless roll can be determined by choosing the correct inner roll diameter and thickness of the wound bags, as illustrated in FIGS. 3–5. Coreless roll 30 has been squared and has vertical side surfaces 32, a center 33, a thickness 34, and a width 36, dimensions 34 and 36 being substantially equal.

FIG. 4 illustrates a slightly flattened roll 40 having a top surface 41 and vertical side surfaces 42 with an elongated center 43. This ratio of width 46 to thickness 44 indicates a shape that is satisfactory for many packaging applications but which is susceptible to considerable twisting if roll 40 is formed from large plastic bags and if the bags are dispensed from center 43.

The highly flattened roll 50 in FIG. 5 possesses a top surface 51, vertical side surfaces 52, a very elongated core line 53, a thickness 54, and a width 56. This highly flattened roll, when put into a dispensing box, forms too thin and large a package, in addition to having a tendency to be unduly flexible, for convenient use in most commercial establishments and private homes. A more compact shape would be desirable, particularly if the bags are large enough for trash bags, such as 30-gallon bags, or if they are used as industrial liners.

Figure 6:
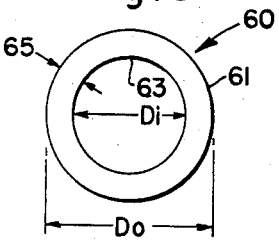
FIG. 6 is an end view of a coreless roll having a large inner diameter.

FIG. 6 shows a roll 60 having a relatively small wound thickness 65, an outer surface 61, and an inner surface 63 of large diameter. The diameter within inner surface 63 is designated $D_i$, and the diameter bounded by outer surface 61 is designated $D_o$. The circumferential length of surface 61 is $D_o$, and the circumferential length of surface 63 is $\pi D_i$. Thickness 65 equals $(D_o - D_i)/2$ and may be represented by T.

Figure 7:
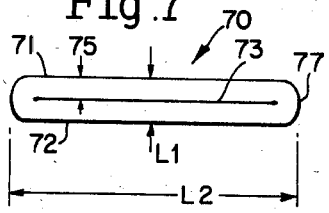
FIG. 7 is an end view of the coreless roll of FIG. 6 after flattening or collapsing thereof.

In FIG. 7, roll 60 is shown as having been flattened or collapsed to form flattened roll 70 having a top surface 71, a bottom surface 72, an elongated core line 73, a wound thickness 75 from the core line to the outer surface, and semicircular edges 77. The length of line 73 in FIG. 7 may then be calculated as $\pi D_i$, and thickness L1 of collapsed roll 70 may be calculated as $(D_o - D_i)$ or 2T. The ratio of thickness to width, $$L_1/L_2 = \frac{D_o - D_i}{D_o - D_i + 0.5\pi D_i}.$$

Figure 8:
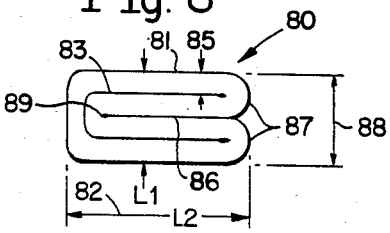
FIG. 8 is an end view of the coreless roll of FIGS. 6 and 7 after singly folding it into a U or horseshoe shape.

In FIG. 8, the collapsed roll 70 of FIG. 7 has been folded again to form horseshoe-folded roll 80 having a top surface 81, a folded core line 83, and a center line 86 which was formerly top surface 71. Line 86 ends at its inner extremity as a wrinkled area 89. Roll 80 continues to have wound thickness 85 which is the same as thicknesses 75 and 65. Its thickness-to-width ratio is the ratio of roll thickness 88 to width 82. Wrinkled area 89 becomes more pronounced as T increases.

Doubled thickness 88 in FIG. 8 is calculated by the formula: $2(D_o - D_i)$ or 4T. Assuming that singly-folded length 82 can be resolved into a semi-circle having a radius T and two straight portions, each having a length calculated by the formula, $$\frac{1}{2}\left(\frac{\pi D_i - \pi T}{2}\right),$$

the thickness-to-width ratio, $L_1/L_2$, (using $L_2$ for width 82 and $L_1$ for thickness 88) can be calculated by the formula, $$\frac{2(D_o - D_i)}{3T + 0.25\pi D_i - 0.5\pi \rightarrow}.$$

It is roll 80 that is a principal subject of this invention because a plastic bag removed from the original inner surface 63, now folded core line 83, has a smaller amount of twist, as compared to the twist in a bag dispensed from collapsed roll 70, while enabling roll 80 to be packaged into a better-proportioned carton having suitable and appropriate dimensions for storage and center dispensing through an aperture in its enclosing carton.

Thickness 88 and folded length 82 are important factors in packaging the horseshoe-folded, center-unwound bags of this invention because individual users have decided preferences as to the dimensions of the boxes from which bags are dispensed, boxes have greater strength as they approach squareness, and commercial users also find that their shelves and counters are better adapted to certain box sizes and dimensions.

Figure 9:
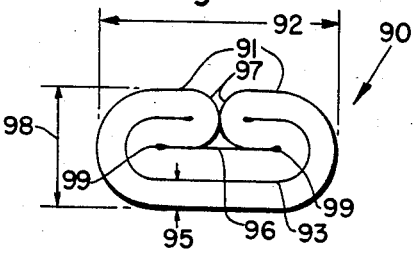
FIG. 9 is an end view of the coreless roll of FIGS. 6 and 7 after doubly folding it into an C shape.

FIG. 9 represents a C-folded roll of plastic bags for center dispensing and minimizing of twist. Its doubled thickness 98 is expressed by the formula, $2(D_o\text{-}D_i)$ Folded ends 77 of bag 70 have become ends 97 in opposed relationship to each other, and top surface 71 of roll 70 has become center surface 96 of bag 90. Straight core line 73 of bag 70 has become C shaped core line 93 of bag 90. Center surface 96 has two folded and wrinkled areas 99, in contrast to the single area 89 in bag 80. This C-folded roll 90 for center dispensing is singly folded, like roll 80, but has an advantage over U-folded roll 80 in that its core line 93 is balanced by wrinkled ends 99 on both ends and by its folded ends 97 being in the middle of the folded roll so that pressures are more nearly balanced in every direction.

Figure 10:
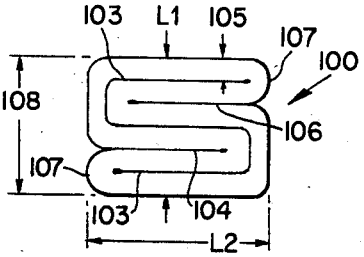
FIG. 10 is an end view of the coreless roll of FIGS. 6 and 7 after doubly folding it into a S shape.

FIG. 10 shows a doubly folded roll 100 for center dispensing and minimizing of twist in large bags. Its tripled thickness 108, corresponding to $L_1$, is expressed by the formula, $3(D_o-D_i)$ or 6T. Folded ends 107 correspond to ends 77 of bag 70. A portion of top surface 71 of roll 70 has become enclosed line 106, and a portion of bottom surface 72 of roll 70 has become enclosed line 104. Straight core line 73 has become S-shaped core line 103. Thickness 105 is the same as thickness 73.

This S-folded roll 100 is highly preferred because, for reasonable values of $D_i$ and of $D_o-D_i$, it comes most closely to forming a square for fitting within a dispensing box. Its width, $L_2$, is expressed by the formula, R+3T, in which all curves are assumed to be rounded, as seen in FIG. 9, for example, rather than flattened for boxing, as seen in FIGS. 8 and 10, for example. As in the formulas for other rolls, no air entrapment is also assumed. The ratio, $L_1/L_2$, is expressed by the formula, $$\frac{3(D_o - D_i)}{3T + 0.33[(0.5\pi D_i) - 2\pi T + T]}$$

Figure 11:
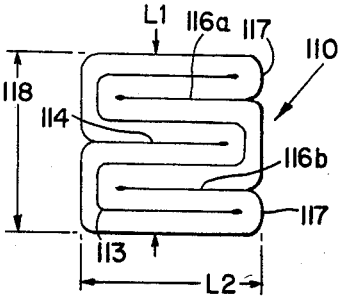
FIG. 11 is an end view of the coreless roll of FIGS. 6 and 7 after triply folding it into an M shape.

FIG. 11 shows a triply folded roll 110 for center dispensing and minimizing of twist in very large bags. Its quadrupled thickness 118, corresponding to $L_1$, is expressed by the formula, $4\ (D_o-D_i)$ or 8T. Folded ends 118 corresponds to ends 77 of bag 70. End portions of top surface 71 have become enclosed lines **116*a*, 116*b*, and a center portion of bottom 72 of roll 70 has become enclosed line 114. Straight core line 73 has become M-shaped core line 113**.

This M-folded roll 110 is also highly preferred, particularly for relatively small T values, whereby a nearly square shape can be produced for boxing. Its width, $L_2$, is expressed by the formula, H+3T, where H is the length of lines **116*a*, 116*b*, and H−T is the length of line 114**, assuming negligible wrinkling and air entrapment and rounded, rather than flattened, curves. The ratio, $L_1/L_2$, is expressed by the formula, $$\frac{4(D_o - D_i)}{3T + 0.25(0.5\pi D_i - 3\pi T + 2T)}.$$

Figure 12:
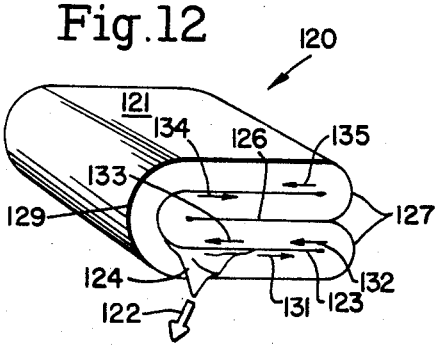
FIG. 12 is an isometric view of a horseshoe folded roll while its innermost bag is being dispensed from its flattened center.

FIG. 12 illustrates a horseshoe folded roll 120 having a top surface 121, singly folded ends 127, a doubly folded end 129, a folded core line 123, a center line 126, and a protruding end 124 of the innermost bag along core line 123. As pull is exerted in direction 122, end 124 is extended and the bag travels sidewise along positions 131, 132, 133, 134, 135, depending upon its length, before the next line of transverse perforations is encountered.

Figure 13:
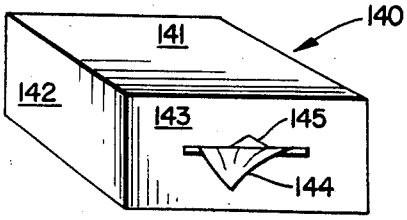
FIG. 13 is an isometric view of a dispensing carton for the folded roll of FIG. 12.

Carton 140 shown in FIG. 13 has a top 141, visible sides 142, 143, and an aperture 145 through which protruding end 144 of roll 120 is visible.

Other horseshoe-folded rolls (not shown in the drawings) are suitable embodiments of this invention, such as W-shaped and accordion-shaped folded rolls. In general, the longer the bag in proportion to inner roll diameter, $D_i$, the more folds are needed. The less the thickness, T, becomes, the more folds are generally feasible, but the greater T becomes, the more accentuated the wrinkled areas (such as areas 89, 99) become, causing difficulties with folding and potentially with dispensing the bags. Maximum T is also to some extent a function of the ratio, $T/D_i$, or the length of the collapsed inner diameter 73, 83, 93, 103, 113. For example, it can be seen by inspection that it would be very difficult to fold bag 40 even once, but if line 43 were at least as long as line 23, it could be feasible to do so.

Data are presented in the table for center-dispensing plastic rolls which are arranged by their inside diameter, $D_i$, from 5 inches to 12 inches, with thickness correspondingly decreasing from 1.6 inches to 0.82 inch, and with degrees of folding that consist of collapsed, single folded (horseshoe), double folded, and triple folded, assuming no air entrapment and negligible wrinkling. The bags listed in this table are made of 0.72 gauge plastic, have a length of 46 inches and an area of 33.12 square inches, and are "250 count", i.e., there are 250 bags per roll.

The last column, entitled "Twist", furnishes the number of turns of twist that occur in the first or innermost bag being centrally dispensed from the inside surface of the roll. As can be seen, the amount of twist decreases asymtotically as the inside diameter increases, with the number of bags per roll, the bag thickness, and the roll length remaining constant.

Figure 14:
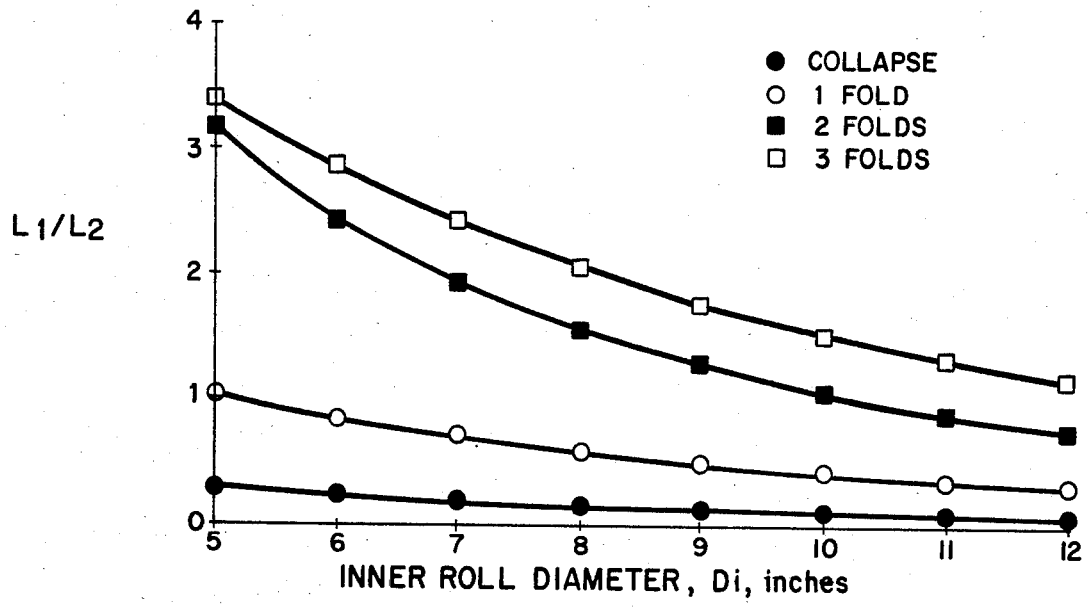
FIG. 14 is a bar graph illustrating the number of turns of twist that occur in a center-dispensed bag versus the inner roll diameter of each roll containing 46-inch liners of 250 count per box, using 0.6–0.8 mil film.

The $L_1/L_2$ values in this table for the collapsed, singly folded, doubly folded, and triply folded rolls are plotted in FIG. 14 against the inner roll diameter, $D_i$. It can readily be observed that if it is desirable to have a substantially square roll and box configuration (i.e., with $L_1=L_2$ or $L_1/L_2=1.0$), a singly-folded roll having an inner diameter of 5 inches, a double folded roll having an inner diameter of 10 inches, and a triply folded roll having an inner diameter of at least 12 inches are the optimum choices.

Figure 15:
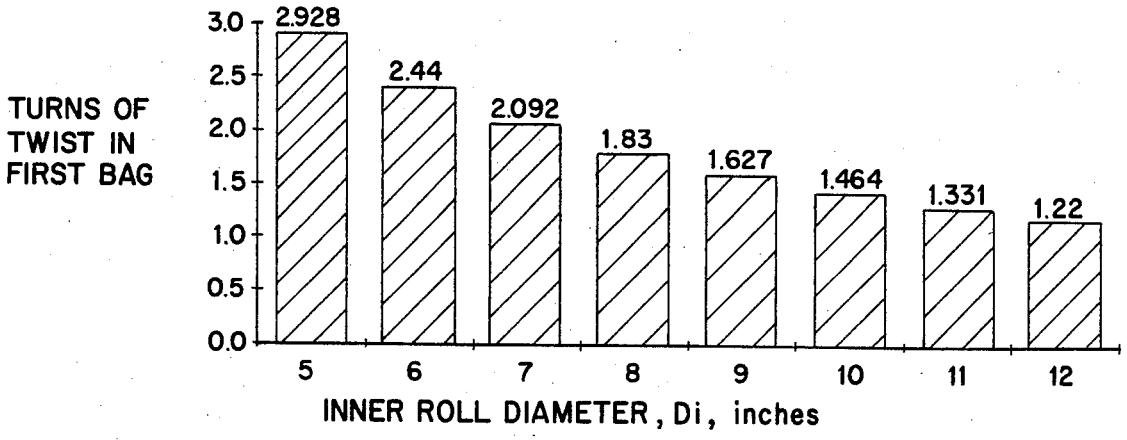
FIG. 15 is a graph showing four curves for the ratio of length/width versus inner roll diameter for collapsed, singly folded, doubly folded, and triply folded plastic bags of 46-inch length, 0.6–0.8 mil thickness film, and 250 count per box.

The number of turns of twist per bag are plotted in FIG. 15 against the inner roll diameters, $D_i$, as bar graphs. It is also clear that if it is desirable to minimize the twisting or roping of a bag being pulled from the center of a roll of selected diameter to, for example, a maximum of 1.5 turns per bag, it is necessary to use an inner core or roll diameter of at least 10 inches.

The highly preferred roll inner diameter is accordingly 10 inches in order to obtain minimum twist/bag while dispensing and to have a square 250-count roll of these 46-inch long bags of 0.72 gauge and a correspondingly square carton.

Similar calculations can be made for bags of any selected gauge, length, and count to enable a roll size, its degree of folding, and its squareness to be selectively designed.

It is to be understood that further embodiments and modifications of the above-described invention are possible within the scope of this invention so that what is intended by such scope and is encompassed by the spirit of this invention is to be construed solely according to the following claims.

| $D_i$, in. | $D_o$, in. | T in. | COLLAPSED BAGS $L_1$ | $L_2$ | $L_1/L_2$ | HORSESHOE BAGS $L_1$ | $L_2$ | $L_1/L_2$ | DOUBLED-FOLDED BAGS $L_1$ | $L_2$ | $L_1/L_2$ | TRIPLE-FOLDED BAGS $L_1$ | $L_2$ | $L_1/L_2$ | TWIST |
|---|---|---|---|---|---|---|---|---|---|---|---|---|---|---|---|
| 5 | 8.196 | 1.598 | 3.196 | 11.05 | 0.289 | 6.391 | 6.211 | 1.029 | 9.587 | 3.018 | 3.177 | 12.78 | 3.791 | 3.372 | 2.928 |
| 6 | 8.841 | 1.421 | 2.841 | 12.27 | 0.232 | 5.683 | 6.743 | 0.843 | 8.524 | 3.489 | 2.443 | 11.37 | 3.981 | 2.855 | 2.44 |
| 7 | 9.548 | 1.274 | 2.548 | 13.54 | 0.188 | 5.097 | 7.319 | 0.696 | 7.645 | 3.968 | 1.927 | 10.19 | 4.206 | 2.423 | 2.092 |
| 8 | 10.3 | 1.152 | 2.304 | 14.87 | 0.155 | 4.608 | 7.93 | 0.561 | 6.912 | 4.454 | 1.552 | 9.215 | 4.459 | 2.067 | 1.83 |
| 9 | 11.1 | 1.049 | 2.098 | 16.24 | 0.129 | 4.196 | 8.568 | 0.49 | 6.295 | 4.945 | 1.273 | 8.393 | 4.734 | 1.773 | 1.627 |
| 10 | 11.92 | 0.962 | 1.923 | 17.63 | 0.109 | 3.847 | 9.229 | 0.417 | 5.77 | 5.44 | 1.061 | 7.694 | 5.027 | 1.531 | 1.464 |
| 11 | 12.77 | 0.887 | 1.774 | 19.05 | 0.093 | 3.548 | 9.907 | 0.358 | 5.321 | 5.938 | 0.896 | 7.095 | 5.334 | 1.33 | 1.331 |
| 12 | 13.64 | 0.822 | 1.644 | 20.49 | 0.08 | 3.289 | 10.6 | 0.31 | 4.933 | 6.44 | 0.766 | 6.578 | 5.653 | 1.164 | 1.22 |

What is claimed is:

1. A plastic bag dispensing assembly from which large attached plastic bags are tensionally dispensed with minimized twisting, comprising:

A. A coreless would roll of said attached plastic bags which are attached but separated by transverse lines of perforations, said roll having an outer diameter, an inner diameter, $D_i$, and an inner circumference, $\pi D_i$, the length of said bags between said lines of perforations being at least equal to said circumference, whereby said minimizing of untwisting is imparted, said attached plastic bags beginning with an innermost bag and ending with an outermost bag, and said roll being flattened, whereby said inner diameter forms a line having a length calculated as $\pi D_i/2$, and horseshoe-folded along at least one fold line in parallel to said lines of perforations, whereby said minimizing of untwisting is preserved; and B. a dispensing carton within which said horseshoe-folded roll is stored, said carton having a dispensing opening through which said innermost bag is initially pulled by a user for dispensing thereof.

2. The assembly of claim 1, wherein said dispensing opening has at least one off-set slot means for grippingly engaging each of said attached plastic bags when selectively and successively slid thereinto, whereby each said bag being pulled by said user is subject to sufficient tension to be torn from the succeeding bag along one said line of perforations.

3. The assembly of claim 1, wherein said horseshoe-folded roll has an essentially square configuration, perpendicularly to said lines of perforations, when viewed from an end thereof.

4. The assembly of claim 3, wherein said horseshoe-folded bag is singly folded in a U shape.

5. The assembly of claim 3, wherein said horseshoe-folded bag is singly folded in a C shape.

6. The assembly of claim 3, wherein said horseshoe-folded bag is doubly folded in an S shape.

7. The assembly of claim 3, wherein said horseshoe-folded bag is triply folded in an M shape.

8. The assembly of claim 3, wherein said horseshoe-folded bag is folded in an accordion shape.

9. A method for minimizing the degree of twist in large plastic bags which are to be tensionally dispensed from the central opening of a wound coreless roll of attached plastic bags separated by transverse lines of perforations, said roll having an inner core diameter and an outer core diameter after winding thereof and said plastic bags having a dimension measured in parallel to the inner circumference of said wound roll that is at least as long as said inner circumference, said method comprising the following steps:

A. collapsing said wound roll;

B. horseshoe folding said collapsed roll along at least one fold line in parallel to said perforations to enable said horseshoe-folded roll to have selected length, width, and height dimensions that can fit into a selected carton having dimensions preferred by a user of said bags; and c. inserting said horseshoe-folded roll into a carton having a dispensing opening in a side thereof.

10. The method of claim 9, wherein said width and height dimensions are approximately equal so that said horseshoe-folded coreless roll has an approximately square configuration, measured perpendicularly to weakening lines that separate said bags.

11. The method of claim 10, wherein said box has an approximately square configuration and a dispensing opening in one approximately square side.

12. The method of claim 10, wherein said horseshoe folding is single folding and forms a U-shaped roll.

13. The method of claim 10, wherein said horseshoe folding is single folding and forms a C-shaped roll.

14. The method of claim 10, wherein said horseshoe folding is double folding and forms an S-shape roll.

15. The method of claim 10, wherein said horseshoe folding is triple folding and forms an M-shaped roll.

16. The method of claim 10, wherein said horseshoe folding forms an accordion-shaped roll.

17. The method of claim 10, wherein said bags are trash bags.

18. The method of claim 14, wherein said bags are industrial liners of 250 count and 0.6–0.8 mil gauge and said S-shaped roll has an inner diameter of at least about 10 inches.

19. A method for successively dispensing attached plastic bags from a coreless roll of center-unwindable plastic bags with minimized twist in each dispensed bag, whereby less manual manipulation is required for untwisting the dispensed bags by the user thereof, wherein said roll has an outer diameter, $D_o$, an inner diameter, $D_i$, a wound thickness, T, equalling $D_o - D_i/2$, and an inner circumference, $\pi D_i$, said attached plastic bags being separated by transverse lines of perforations and extending from an innermost bag along said inner circumference to an outermost bag along said outer circumference, and the distance between said perforations being the length of each said bag, said method comprising the following steps:

A. forming said roll so that said bag length at least equals said inner circumference;

B. collapsing said roll to form a flattened roll having:

(1) a pair of ends, (2) an elongated core line which is formed from said inner circumference and has a length, $L_2$, calculated as $\pi D_i/2$, and (3) a selected ratio of roll thickness to roll width, $L_1/L_2$; and C. selectively folding said flattened roll to form a horseshoe-folded coreless roll which has a nearly square configuration when viewed from an end thereof.

20. The method of claim 19, wherein:

A. said folding of said step C is single folding of one said end onto the other said end, so that said roll is U-folded; and B. the doubled roll thickness, $L_1$, of said flattened and folded roll equals 4T and the width, $L_2$, thereof approximately equals $(3T+0.25\pi D_i-0.5\pi T$.

21. The method of claim 20, wherein said single folding is performed from each end of said pair of ends of said step B of claim 19 to form a C-folded roll of said plastic bags, whereby said folded ends are in the middle of said roll.

22. The method of claim 20, wherein said folding of one said end is again performed in the reverse direction from said folding of said one end to form an S-folded roll having double folds and a doubled roll thickness. $L_I$, equalling 6T, the ratio of roll thickness to roll width, $L_I/L_2$, approximately equalling $$\frac{6T}{3T + 0.33[(0.5\pi D_i) - 2\pi T + T]}.$$

23. The method of claim 22, wherein said folding of said one end is again performed in the same direction as said single folding of said one end to form an M-folded roll having triple folds and a tripled roll thickness, $L_1$, equalling 8T, the ratio of roll thickness to roll width, $L_I/L_2$, approximately equalling $$\frac{8T}{3T + 0.25(0.5\pi D_1 - 3\pi T + 2T)}$$

* * * * *

UNITED STATES PATENT AND TRADEMARK OFFICE

CERTIFICATE OF CORRECTION

PATENT NO. : 4,597,494

DATED : July 1, 1986

INVENTOR(S) : Gordon L. Benoit

It is certified that error appears in the above-identified patent and that said Letters Patent is hereby corrected as shown below:

Column 6, line 26, "$\pi D_i$" should be —$\frac{\pi D_i}{2}$—.

Column 6, line 27, "Ll" should be —$L_1$—.

Column 6, line 56, delete the arrow symbol in the formula and insert —T—.

Column 8, line 43, delete "bag" and insert —roll—.

Column 9, line 25, delete "would" and insert —wound—.

Column 12, line 19, "$L_1/L_2$" should be —$L/L_2$—.

Signed and Sealed this

Sixth Day of October, 1987

*Attest:*

DONALD J. QUIGG

*Attesting Officer*

*Commissioner of Patents and Trademarks*